US006015315A

United States Patent [19]

Ensign et al.

[11] Patent Number: 6,015,315

[45] Date of Patent: Jan. 18, 2000

[54] IMPEDANCE IMPROVED COAX CONNECTOR

[75] Inventors: Lawrence Frank Ensign, Tustin; Wayde Barry King, Placentia, both of Calif.

[73] Assignee: ITT Manufacturing Enterprises, Inc., Wilmington, Del.

[21] Appl. No.: 09/192,658

[22] Filed: Nov. 16, 1998

[51] Int. Cl.[7] ..... H01R 13/00

[52] U.S. Cl. ..... 439/578

[58] Field of Search ..... 439/578, 579, 439/580, 581, 582, 583, 584, 585, 675

[56] References Cited

U.S. PATENT DOCUMENTS

| | | | |
|---|---|---|---|
| 4,035,054 | 7/1977 | Lattanzi | 339/177 |
| 4,456,324 | 6/1984 | Staeger | 339/177 |
| 4,824,399 | 4/1989 | Bogar et al. | 439/578 |
| 4,859,197 | 8/1989 | Toramoto et al. | 439/675 |
| 4,867,703 | 9/1989 | Flanagan et al. | 439/578 |
| 4,981,445 | 1/1991 | Bacher et al. | 439/578 |
| 5,041,020 | 8/1991 | Michael | 439/578 |
| 5,100,344 | 3/1992 | Truong | 439/578 |
| 5,167,532 | 12/1992 | Bruno et al. | 439/578 |
| 5,454,736 | 10/1995 | Chou | 439/578 |
| 5,516,307 | 5/1996 | Cartesse et al. | 439/581 |
| 5,691,251 | 11/1997 | Skopic | 439/675 |

*Primary Examiner*—Paula Bradley
*Assistant Examiner*—Tho D. Ta
*Attorney, Agent, or Firm*—Thomas L. Peterson

[57] ABSTRACT

A low cost miniature standard-sized coaxial connector has an increased impedance at its rear portion in a simple and rugged construction. A one-piece molded insulator (16) lies within a sheet metal shell (14) and supports a center contact (18) of the connector. The insulator has a rear portion (34) with a cylindrical sleeve-shaped part (50) closely received within the shell and with three ribs (60–64) extending radially inwardly and having free radially inner ends (68). The center contact has a barb (40) lying in an interference fit within the inner ends of the ribs. The insulator forms a pin lead-in (44) at the front end of the connector, and forms a coupling part (80) between the rearward portion and the lead-in part. The coupling part is in the form of a cylindrical sleeve along its lower half, and has an upwardly-extending slot (82) along its upper half.

7 Claims, 3 Drawing Sheets

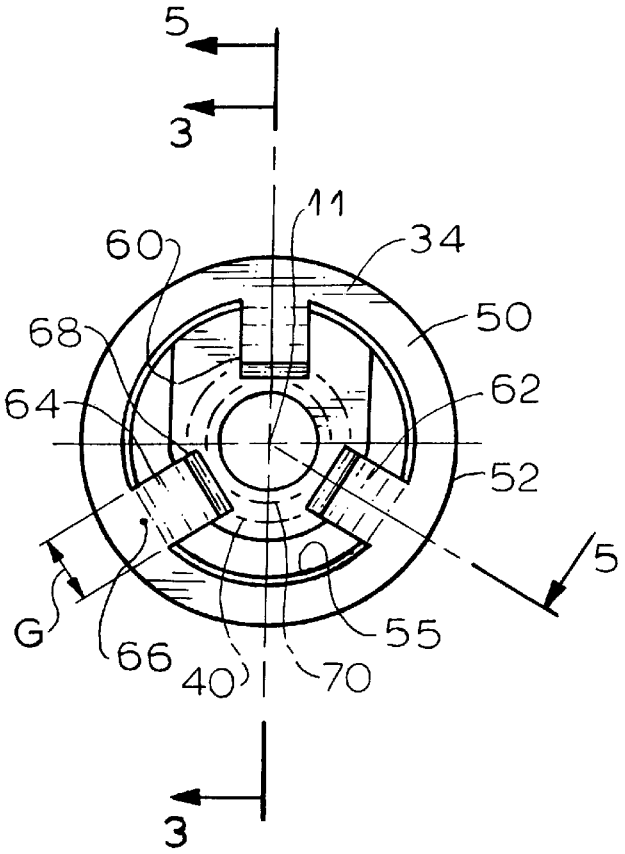
FIG. 4
FIG. 7
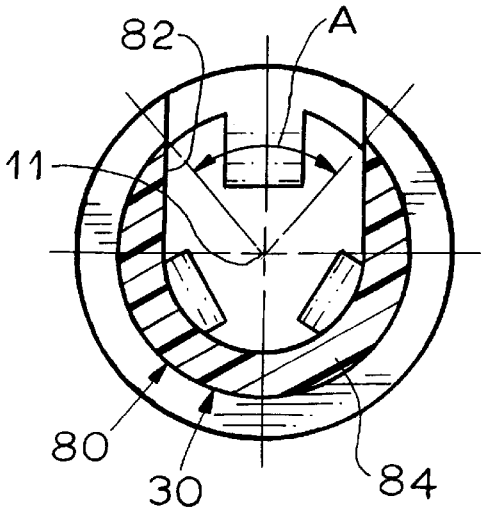

IMPEDANCE IMPROVED COAX CONNECTOR

BACKGROUND OF THE INVENTION

Coaxial connectors are manufactured in predetermined sizes and with predetermined nominal impedances, such as 50 ohms or 75 ohms. One type of miniature coaxial connector is the size 8, 75 Ohm D-sub connector whose center contacts include a pin of 0.04 inch (1 mm) diameter, and a plug outer shell of 0.153 inch outside diameter at the front portion and 0.188 inch outside diameter at the rear portion. Where a simple solid insulator is used that provides clearance only around a socket contact at the front portion, the front portion has an impedance of about 40 ohms and the rear portion has an impedance of about 85 ohms, resulting in an average of about 65 ohms, which is considerably less than the desired 75 ohms. The impedance can be raised by constructing the insulator with air spaces, but this can lead to a structurally weak insulator that is easily damaged during insertion of the center contact, especially because of the small size of the parts of the miniature connector. It should be noted that low cost dictates that the insulator be a one-piece molded part. A low cost miniature coaxial connector whose impedance was closer to the nominal impedance, such as 75 ohms, but which was still of rugged construction, would be of value.

SUMMARY OF THE INVENTION

In accordance with one embodiment of the present invention, a miniature coaxial connector of standard size is provided, which is rugged and of low cost, and which has an impedance that is closer to the nominal impedance of the connector. The connector includes a sheet metal shell forming an outer contact, a center contact extending along the axis of the connector, and an insulator that holds the center contact within the shell. The insulator has a rear portion comprising a cylindrical sleeve-shaped part extending 360° about the axis and has three ribs extending radially inwardly from the sleeve and having free radially inner ends. The contact has a barb that lies in interference fit with the free inner ends of the ribs. The sleeve has a forward portion with a pin lead-in at its front end, and with a sleeve having a large radial slot therein to aid in molding the insulator.

The novel features of the invention are set forth with particularity in the appended claims. The invention will be best understood from the following description when read in conjunction with the accompanying drawings.

BRIEF DESCRIPTION OF THE DRAWINGS

FIG. 4 is a rear end view of the insulator of the connector of FIG. 3, as seen along line 4—4 of FIG. 5.

FIG. 7 is a sectional view taken on line 7—7 of FIG. 5.

DESCRIPTION OF THE PREFERRED EMBODIMENT

Figures 1, 2:
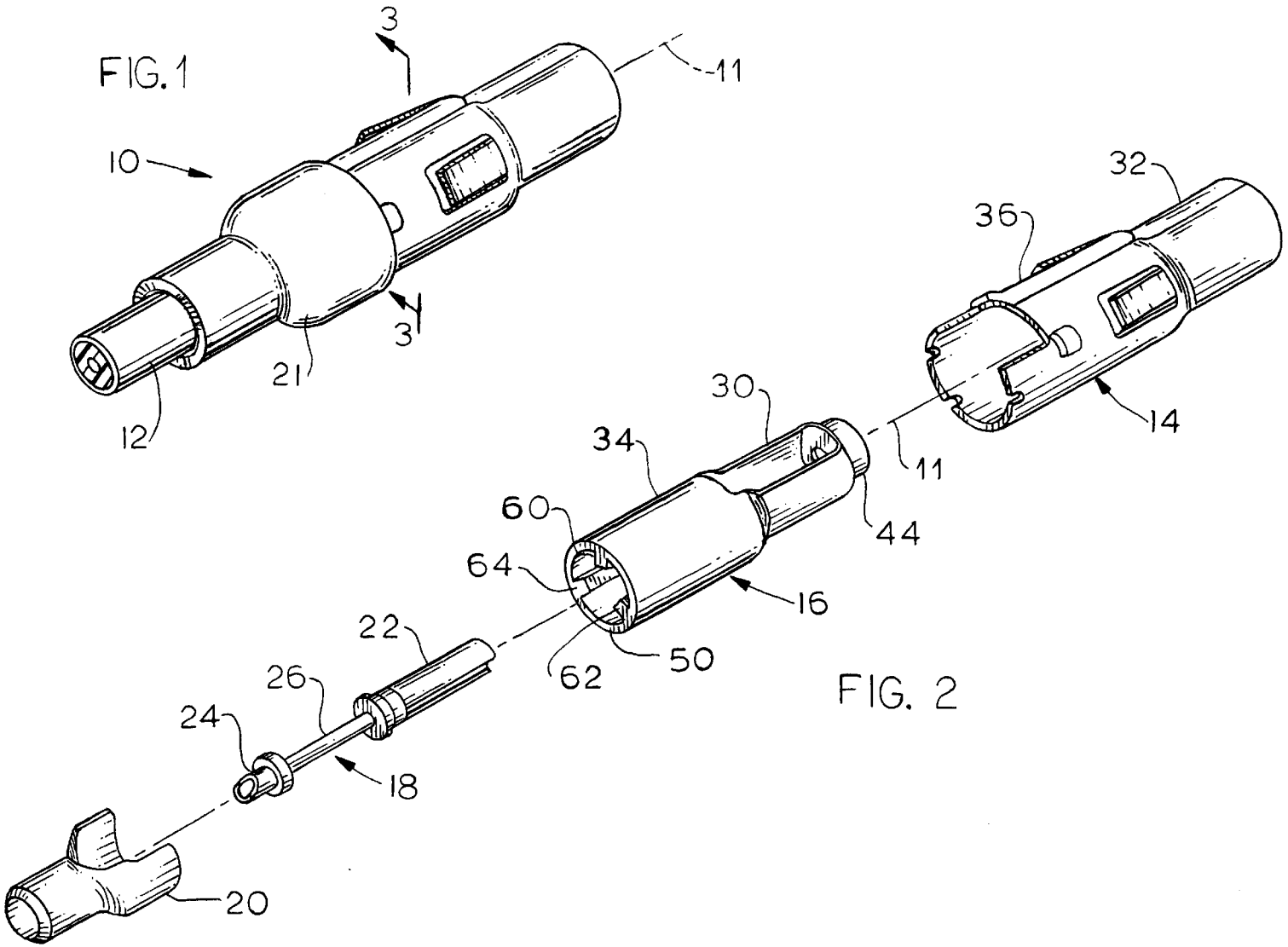
FIG. 1 is a rear isometric view of a plug coaxial connector constructed in accordance with the present invention, with a cable extending from the rear thereof.
FIG. 2 is an exploded isometric view of the connector of FIG. 1.

FIG. 1 illustrates a plug coaxial connector 10, with a coaxial cable 12 extending from its rear end. FIG. 2 shows that the connector includes a sheet metal shell 14, an insulator 16 that lies within the shell, and a center contact 18 that lies within the insulator. A rear ferrule 20 lies at the rear end of the connector and a rear end cap 21 closes the rear end. The center contact 18 includes a front portion 22 in the form of a socket, a rear portion 24 that forms a recess for receiving and soldering to a cable center conductor, and a small diameter mid part 26. The insulator has a front portion 30 that lies within a front portion 32 of the sheet metal shell 14. The insulator also has a rear portion 34 that lies within a rear portion 36 of the shell.

Figure 3:
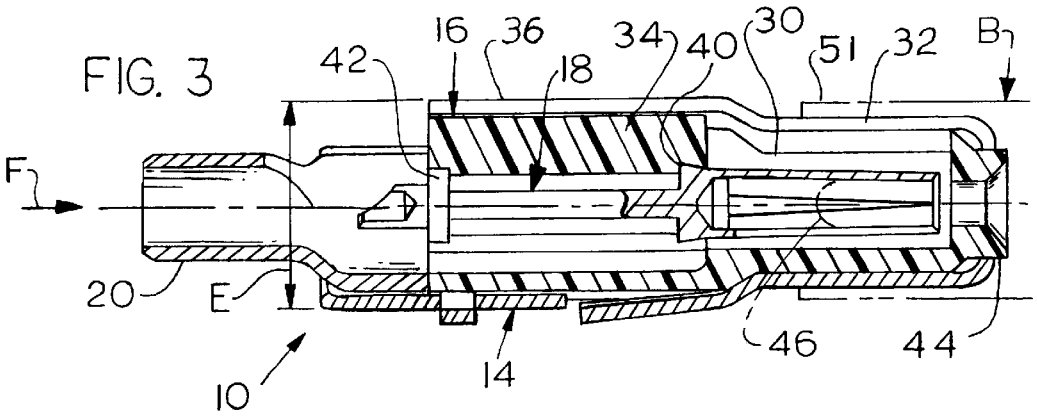
FIG. 3 is a sectional view taken on line 3—3 of FIG. 1 and line 3—3 of FIG. 4.

FIG. 3 shows the shell 14, insulator 16, and center contact 18 fully assembled. The center contact 18 is installed in the insulator by moving the center contact in a forward direction F into place. The center contact has a barb 40 and a flange 42 that hold it to the insulator, with the barb 40 lying in interference fit with the insulator. The front portion 30 of the insulator includes a pin lead-in 44 that is designed to guide a pin 46 of a mating connector into place, while an outer terminal 51 of the mating connector slides around the shell. The shell front portion 32 that is designed to be received in the outer terminal 51 of the mating connector, and the shell rear portion 36 is of a size to fit into a passage of a large connector housing that may hold the connector 10 and other connectors.

Figure 5:
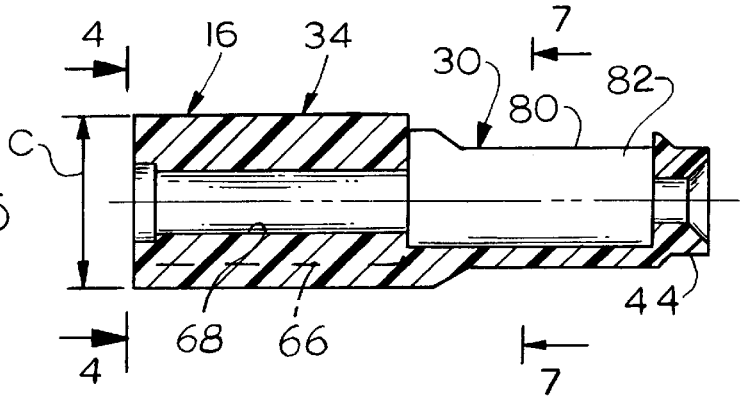
FIG. 5 is a sectional view of the insulator of FIG. 4, taken on line 5—5 thereof.
Figure 6:
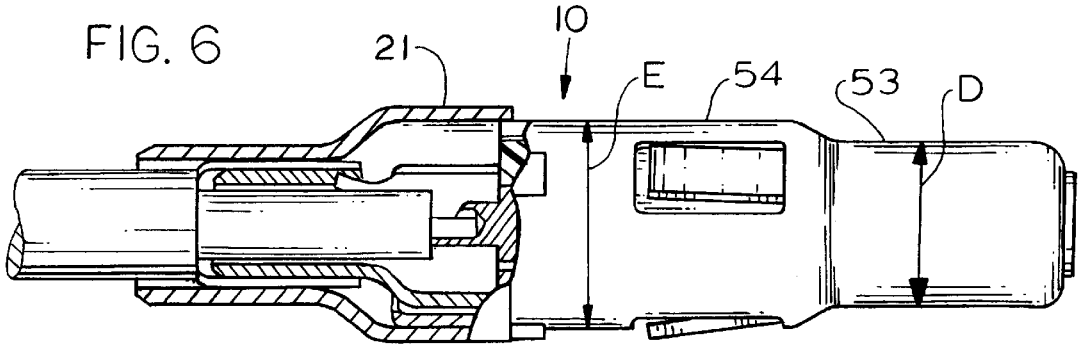
FIG. 6 is a partially sectional side view of the connector of FIG. 3, but with a cable and rear end cap in place.

FIG. 4 is a rear view of the insulator 16, showing the insulator rear portion 34 which is of substantially constant cross section throughout the length of the rear portion. The insulator rear portion includes a cylindrical sleeve-shaped part 50 that preferably has a cylindrical outer surface 52 and cylindrical inner surface 55, although this is not necessary for the invention. The rear insulator portion also has three ribs 60, 62, 64 with radially outer ends 66 that merge with the sleeve-shaped portion 50 and with radially inner ends 68 that are free ends in that they are unconnected to the other ribs. The barb 40 on the center contact 18 of FIG. 3, lies in an interference fit with the three ribs 60–64, to prevent rearward movement of the inner contact. As shown in FIG. 5, the insulator front portion 30 has a coupling part 80 in the form of a sleeve with a large vertical slot 82. The slot 82 is provided to enable molding of the insulator, as well as to increase air volume to increase the impedance in the mating area. FIG. 7 shows that the slot subtends an angle A of about 90°, leaving a sleeve-shaped coupling part 80 that subtends an angle of about 270°. The coupling part includes a cylindrical bottom 84 subtending 180° and upstanding walls. This results in rigidity for the coupling part 80 to prevent its column-like collapse when a forward force is applied to the lead-in 44 (FIG. 5).

The provision of the three ribs 60–64 of FIG. 4 provides ruggedness while leaving considerable empty space within the outer shell rear portion. The empty space increases the characteristic impedance of the rear portion of the connector, that includes the shell rear portion 36 (FIG. 3) and the insulator rear portion 34 therewithin. The front portion 30 of the insulator, which lies within the shell front portion 32, has an impedance of about 40 ohms. If a solid insulator, with no air space, lies within the shell rear portion 36, then the rear portion of the connector has an impedance of about 85 ohms. The result is an average impedance for the connector of about 65 ohms, which is substantially less than the designated characteristic impedance of 75 ohms for the connector. A lower impedance results in losses. By applicant providing an insulator rear portion 34 with air space (between the ribs) applicant raises the impedance of the rear portion of the connector to about 100 ohms, resulting in an impedance for the connector of about 75 ohms. Although the impedance at the front and rear are both considerably different than 75 ohms, resulting in signal reflections and consequent losses, the losses are less than would be achieved with an overall impedance of considerably less than 75 ohms. It is noted that above about 1 GHz, the losses from reflections are usually too high for practical use.

When the center contact 18 of FIG. 3 is installed, it is pushed forwardly. The diameter of the center contact 18 is minimized to maintain the required impedance in the rear portion of the connector. The center contact 18 of FIG. 3 can withstand a compression force along its length of up to about 30 pounds before it undergoes column collapse. When another connector B mates with the connector 10, the pin 46 of the mating connector will apply a rearward force. The barb 40 and insulator 16 withstand a force of at least 2 pounds during mating. Previously, coaxial connector insulators with radial ribs, have had the ribs connected together by a small diameter sleeve of insulation material. To maintain considerable airspace the ribs were thinner than applicants, and the design involved a more complicated molding die. Applicant's use of ribs, and with the center contact barb directly engaging the radially inner free ends of the ribs, allows the use of thick ribs and results in a connector of simple design that is robust. It should be emphasized that the connector and its parts are of very small size, with the insulator outside diameter C (FIG. 5) being only 0.157 inch (3.99 mm) so that high ruggedness is required to prevent damage during rough handling in the assembly and use. Applicant's direct interference engagement of the center contact with the free ends of the ribs results in engagement of rugged parts of the insulator. The coupling part 80 of the insulator front portion is also rugged because it extends by much more than a half circle around the axis of the connector.

The ribs 60–64 are preferably angled about 120° apart about the axis 11 of the connector, so that the angle between any two adjacent ribs is at least 105°. In a connector of the construction illustrated that applicant has designed, the shell is formed of sheet metal of about 0.015 inch thickness, with the shell front portion 32 having an outside diameter D of 0.153 inch and the shell rear portion 36 of an outside diameter E of 0.189 inch. The insulator rear portion has an outside diameter C of 0.157 inch to be closely received within the shell (a clearance of no more than a few thousandths inch). Each of the ribs has a width G (FIG. 4) of 0.036 inch, which is at least 60% (actually 65%) of the diameter of an imaginary circle 70 on which the rib inner ends 68 lie.

Thus, the invention provides a low cost and rugged coaxial connector with a characteristic impedance close to a particular level such as 75 ohms by increasing the impedance of the rear portion of the connector to compensate for the low impedance of the front portion. The rear portion includes an insulator with a sleeve-shaped portion and a plurality of ribs, preferably three uniformly spaced ribs, extending radially inwardly from the sleeve and having three radially inner free ends. The center conductor of the connector is supported on the three ends of the ribs, with the central conductor having a barb lying in interference fit with the ribs. The front portion of the connector is preferably in the form of a sleeve that holds a pin lead-in at the front end. The sleeve in the front portion has a slot which leaves the sleeve so it extends by more than 180° and preferably about 270° for ruggedness.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A coaxial connector which has an axis, a metal shell with front and rear shell portions of generally cylindrical shape, a center contact lying within said shell and extending along said axis, and an insulator which supports said center contact within said shell, wherein:

said center contact has a front mating end and said shell has a front end that surrounds substantially all of said contact mating end to shield said contact mating end and provide the coaxial connector;

said insulator has a rear insulator portion lying in said rear shell portion, said rear insulator portion having a sleeve-shaped part lying closely within said shell and having at least three axially extending ribs, said ribs extending primarily radially inwardly from said sleeve-shaped part, with said ribs having radially inner free ends;

said center contact lying closely within said free ends of said ribs, to reduce the amount of solid material of said rear insulator portion and thereby increase the characteristic impedance of the portion of said coaxial connector that surrounds said rear insulator portion.

2. The connector described in claim 1 wherein:

said insulator has a front insulator portion with a coupling part and with a front part forming a pin lead-in at a front end of said coupling part;

said coupling part of said front insulator portion being in the form of a sleeve that extends continually at least 180° about said axis and that has a radially-extending mold-facilitating slot at one side of said sleeve, with said slot being free of undercuts as viewed along said axis.

3. The connector described in claim 1 wherein:

said at least three ribs consists of three ribs angled apart by substantially 120°, to thereby minimize the amount of solid material required to support the contact.

4. The connector described in claim 1 wherein:

said shell has a rear shell portion which has a cylindrical inner surface of predetermined diameter that closely surrounds said rear insulator portion;

said insulator has a front insulator portion of smaller outside diameter than said rear insulator portion, and said shell has a front shell portion that closely surrounds said front insulator portion.

5. A coaxial connector, comprising:

a one-piece sheet metal shell having a cylindrical forward portion of a first diameter and a cylindrical rearward portion of a larger second diameter, with both of said cylindrical portions centered on an axis;

a center contact lying within said shell and extending along said axis;

a one-piece molded insulator that lies within said shell and that supports said center contact, said insulator having a rear portion with a sleeve-shaped part extending 360° about said axis along a majority of the length of said shell rearward portion and lying closely within said rearward portion of said shell, said insulator rear portion also having three axially extending ribs, said ribs extending primarily radial to said axis and having radially outer rib ends merging with said sleeve-shaped parts and radially inner rib ends that are free ends;

said center contact lying in an interference fit with said rib free ends.

6. The connector described in claim 5 wherein:

said insulator has a forward portion with a coupling part of substantially cylindrical inside and outside shape about 180° along around said axis, with said coupling part extending about three-quarters of a circle about said axis and merging with said sleeve-shaped part of said insulator rear portion and with said coupling part lying closely within said shell forward portion, said insulator forward portion having a front part forming a pin lead in.

7. The connector described in claim 6 wherein:

said insulator coupling part of cylindrical shape has a slot at one side, with said coupling part having a slot width in a direction perpendicular to said axis, which is equal to the inside diameter of said insulator forward portion.

* * * * *